US008481880B2

(12) United States Patent
Böttcher et al.

(10) Patent No.: US 8,481,880 B2
(45) Date of Patent: Jul. 9, 2013

(54) DRIVE SYSTEM FOR ELECTRICAL SWITCHING DEVICES

(75) Inventors: Martin Böttcher, Berlin (DE); Marcus Kampf, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 403 days.

(21) Appl. No.: 12/995,880

(22) PCT Filed: May 27, 2009

(86) PCT No.: PCT/EP2009/056398

§ 371 (c)(1),
(2), (4) Date: Dec. 2, 2010

(87) PCT Pub. No.: WO2009/147032

PCT Pub. Date: Dec. 10, 2009

(65) Prior Publication Data

US 2011/0073453 A1 Mar. 31, 2011

(30) Foreign Application Priority Data

Jun. 2, 2008 (DE) ..... 10 2008 026 798

(51) Int. Cl.
*H01H 9/00* (2006.01)
*H01H 33/42* (2006.01)

(52) U.S. Cl.
USPC ..... 200/400; 218/154

(58) Field of Classification Search
USPC ..... 200/17 R, 400, 401, 500, 501, 318, 200/320, 323–327, 337
See application file for complete search history.

(56) References Cited

U.S. PATENT DOCUMENTS

| | | | | |
|---|---|---|---|---|
| 4,507,641 | A | 3/1985 | Poth | |
| 5,504,293 | A * | 4/1996 | Rogers et al. | 218/154 |
| 6,515,245 | B2 * | 2/2003 | Marin-Pache et al. | 200/400 |
| 6,610,949 | B2 * | 8/2003 | Mori et al. | 200/400 |
| 7,053,324 | B2 * | 5/2006 | Shin | 200/400 |
| 7,671,292 | B2 * | 3/2010 | Suter et al. | 200/400 |
| 7,696,447 | B2 * | 4/2010 | Chen et al. | 200/400 |
| 2005/0241928 | A1 * | 11/2005 | McCord et al. | 200/400 |

FOREIGN PATENT DOCUMENTS

| | | | |
|---|---|---|---|
| CN | 1172548 | A | 2/1998 |
| DE | 1 087 228 | | 8/1960 |
| DE | 1087228 | B | 8/1960 |
| DE | 32 39 839 | C1 | 3/1984 |
| DE | 44 32 420 | A1 | 3/1996 |
| EP | 0 110 082 | A2 | 6/1984 |

* cited by examiner

*Primary Examiner* — Michael Friedhofer
(74) *Attorney, Agent, or Firm* — Laurence A. Greenberg; Werner H. Stemer; Ralph E. Locher

(57) ABSTRACT

A modular cost-effective drive system for electrical switching devices of medium-voltage installations is specified. The drive system, by the addition or omission of individual components, can be used both as a three-position disconnector with a snap-action or storage drive function and as a two-position circuit breaker which can also be expanded by a brief interruption function.

11 Claims, 4 Drawing Sheets

DRIVE SYSTEM FOR ELECTRICAL SWITCHING DEVICES

BACKGROUND OF THE INVENTION

Field of the Invention

The invention relates to a drive system for electrical switching devices for medium-voltage switchgear assemblies with a different function, which has drive springs which are loaded via operating shafts and act on an output shaft which is connected to the switching element of a switching device.

Switching devices with a different function, for example circuit breakers, load switch disconnectors, switch disconnectors or grounding devices are used in medium-voltage switchgear assemblies in the form of three-position and two-position switches with the functions ON, OFF and GROUND or OFF and ON and optionally a brief interruption function OFF-ON-OFF and are equipped with respectively individually designed, different drives, depending on their function and the respective requirements. The production effort and cost for the drives, which are designed differently to correspond to the respective switch type, are correspondingly high. By way of example, DE 3239839 C1 describes a drive for an electrical three-position switch, which comprises both a snap-action drive assembly and a storage drive assembly. In the case of the snap-action drive, a bending spring can be loaded such that the load can be suddenly removed from it and a switching shaft together with a crank lever can rotate from an OFF mid-position in the ON direction, and in the other direction to GROUND and vice versa. The storage drive assembly which, in addition to the crank lever, has a multiplicity of further components, is combined with the snap-action drive assembly such that, when a fuse blows or the signal from a shunt release occurs, switching takes place from ON to OFF via the storage drive assembly, while only the snap-action drive assembly operates for direct drive operation.

BRIEF SUMMARY OF THE INVENTION

The invention is based on the object of specifying a drive of modular design for electrical switching devices for medium-voltage assemblies which can be used for switching devices with different tasks, with minor design modifications and therefore with little production effort and cost.

According to the invention, the object is achieved by a drive system which can be upgraded in a modular form.

The fundamental idea of the invention is to provide a drive system of modular design which can be modified by the addition of individual additional components or the omission of individual components, that is to say with little design effort and cost, such that it can be used both for three-position switch disconnectors with a snap-action drive or storage drive function and for two-position circuit breakers with or without a brief interruption capability (OFF-ON-OFF).

In comparison to the first drive variant with a snap-action drive function, which has blocking catches for tripping via cam disks of a first drive spring, for a three-position switch, a second drive variant with a storage drive function for changing between ON and OFF has a second drive spring as well as additional first and second storage drive blocking catches, which can be tripped manually via tripping half-shafts and correspond to the first and the second drive springs. As the basis for all modifications, the drive system has a first operating shaft which is connected to a first drive spring and is connected via an output shaft to a switching element of the switching device, as well as a second operating shaft, which is connected to the first operating shaft via gearwheels such that they engage.

In the embodiment as a three-position disconnector with a snap-action function, the first drive spring has an associated first blocking catch for switching the OFF and GROUNDED position and a second blocking catch for switching the ON and OFF position.

In order to achieve the ON and OFF position of the switching element via a storage drive, the second operating shaft may have an associated second drive spring and a second storage blocking catch, which corresponds thereto, in combination with a second tripping half-shaft, and the first drive spring is associated with a first storage blocking catch in combination with a first tripping half-shaft. In the case of a three-position disconnector, the switching between the OFF and GROUNDED position also in this case takes place as a snap-action drive via the first drive spring and the first blocking catch. When used as a two-position circuit breaker, the first and second blocking catches are in this case omitted.

The two-position circuit breaker may additionally have an OFF-ON-OFF brief interruption function, by arranging a clutch between the output shaft and the switching device. The clutch comprises first and second clutch disks, which are connected via a storage blocking catch. The first clutch disk, which is held temporarily on the second tripping half-shaft via the storage blocking catch, is connected to an additional drive spring in order to achieve the OFF position.

One exemplary embodiment of the invention will be explained in more detail with reference to the drawing. In the drawing, in each case illustrated in perspective as front and rear views:

BRIEF DESCRIPTION OF THE SEVERAL VIEWS OF THE DRAWING

FIG. 3 shows a third drive variant for a two-position circuit breaker with a storage drive function according to the drive variant shown in FIG. 2 for changing between OFF and ON.

DESCRIPTION OF THE INVENTION

The drive, which is in modular form for four switch variants, is in each case mounted between two mounting plates 1 and 2.

Figure 1A:
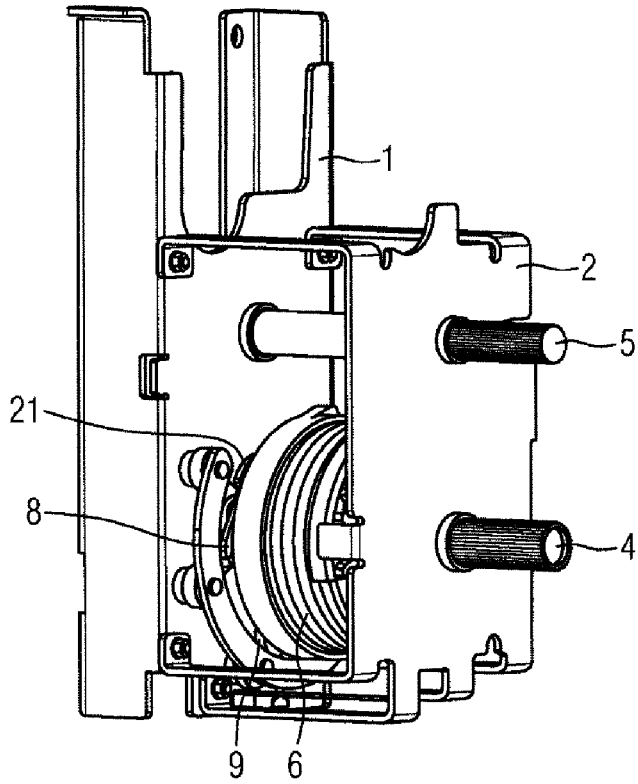
FIGS. 1*a* and 1*b* show a first drive variant for a three-position switch disconnector with a snap-action drive function between the positions ON, OFF and GROUNDED.
Figure 1B:
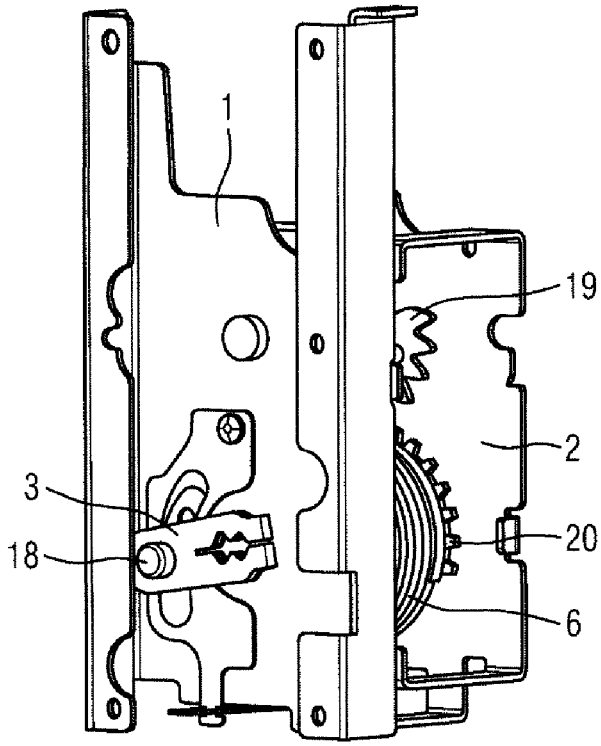

The first drive variant as shown in FIG. 1 is intended for a three-position switch disconnector with the switch positions OFF, ON and GROUNDED. The change between the three switch positions takes place via a snap-action drive function, with a first drive spring 6, which is in the form of a rotary spring in this case, being loaded manually via a first or second operating shaft 4, 5 with the aid of a control lever or else by motor force, and having the load removed from it again by releasing a first or second blocking catch 8, 9, which is tripped via cam disks 21, in order to move the switching element of the switching device to the respective switch position via an output shaft 18, which is driven by the first drive spring 6, and an output lever 3 which is connected thereto. The first operating shaft 4 and the second operating shaft 5 are connected to one another via gearwheels 19, 20. The second operating shaft 5 is used for the disconnector function. A rotary movement of the second operating shaft 5 to the right loads the first drive spring 6 in order to achieve the ON switch position, and a rotary movement to the left results in the OFF switch position. The energy which is produced by the rotary movement in the first drive spring 6 is released by the second blocking catch 9 and then acts on the output shaft 18 and, in the end, on the output lever 3 which is connected to a switching element. The first operating shaft 4 is intended for the grounding device function of the switching element, in that the first drive spring 6 is loaded by rotation of the first operating shaft 4 to the right in order to achieve the GROUNDED switch position, and by rotation of the first operating shaft 4 to the left in order to achieve the OFF switch position. The release of the spring load for switching from OFF to GROUNDED and back is produced by releasing the first blocking catch 8.

Figure 2A:
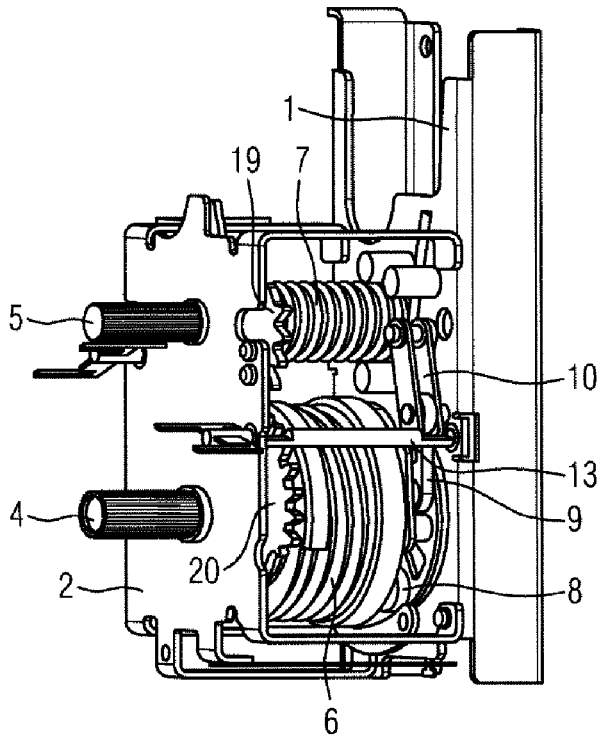
FIGS. 2*a* and 2*b* show a second drive variant for a three-position switch disconnector with a storage drive function between the positions ON and OFF, and a snap-action drive function for changing between OFF and GROUNDED, according to the drive variant shown in FIG. 1.
Figure 2B:
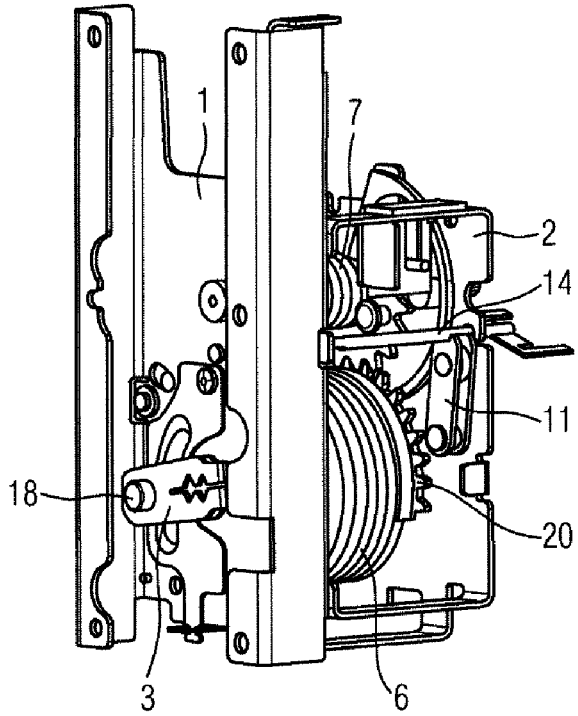

According to the second drive variant, as illustrated in FIG. 2, for a three-position switch disconnector (ON, OFF, GROUNDED), the change between the OFF and the GROUNDED switch positions—as in the case of the first drive variant—still takes place as a snap-action drive by loading the first drive spring 6 by means of the first operating shaft 4, and releasing it by tripping the first blocking catch 8. In this case, however, the change between the ON and the OFF position takes place by storage tripping of the first drive spring 6 and an additional second drive spring 7. The second operating shaft 5 has an associated second drive spring 7, which acts as a storage drive spring for switching to OFF. The first drive spring 6 is operatively connected to a first storage drive blocking catch 10, which is coupled to a first tripping half-shaft 13, and the second drive spring 7 is operatively connected to a second storage drive blocking catch 11, which is coupled to a second tripping half-shaft 14. In order to switch to ON, the tripping half-shaft 13 is rotated by pushing a button, as a result of which the first storage drive blocking catch 10 and therefore the energy stored in the loaded first drive spring 6 are released, and can act on the output shaft 18 for switching on. To switch to OFF, the second storage drive blocking catch 11 and therefore the energy in the loaded second drive spring 7 are released by rotation of the second half-shaft 14, in order to move the switching element to the OFF position, via the output shaft 18 and the output lever 3.

Figure 3:
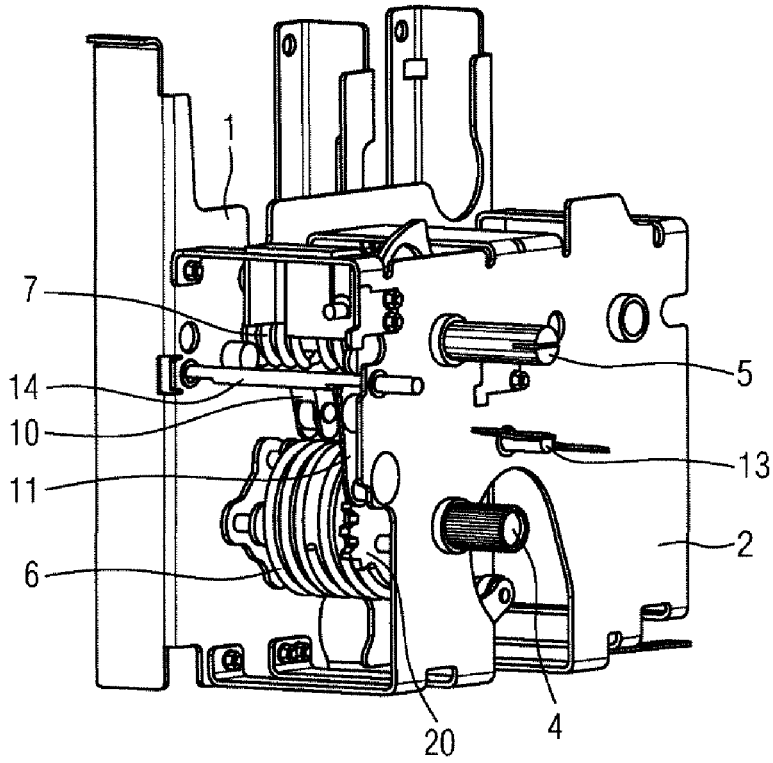

The third drive variant, illustrated in FIG. 3, with minor modifications in comparison to the second embodiment variant, to be precise by the omission of the cam disk with the first and second blocking catches 8 and 9, is designed only for a two-position circuit breaker. The change between the ON and the OFF position and vice versa takes place as described with reference to FIG. 2. The "loading" function of the first drive spring 6 for switching to GROUNDED and back is not required, and the parts which are required for this purpose are not provided in this drive variant.

Figure 4A:
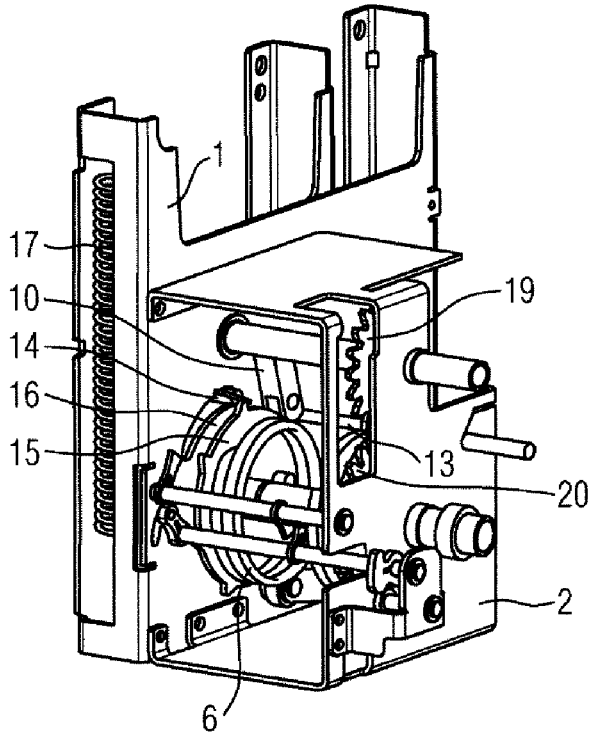
FIGS. 4*a*, 4*b* and 4*c* show a fourth drive variant, in which the drive for the two-position circuit breaker as shown in FIG. 3 has had a brief interruption function OFF-ON-OFF added to it.
Figure 4B:
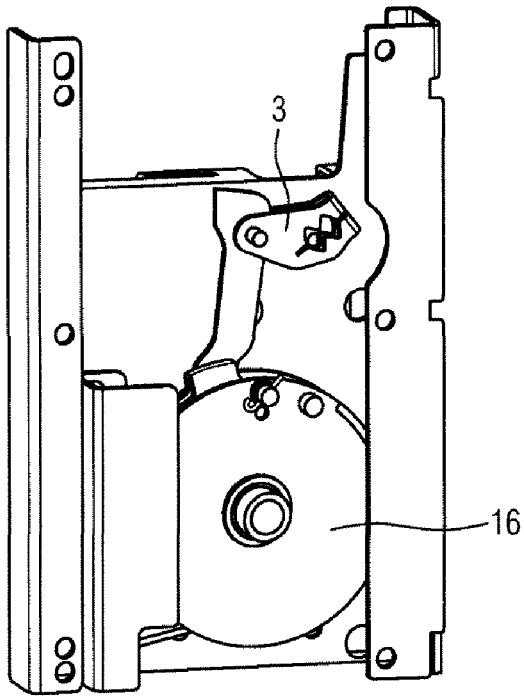
Figure 4C:
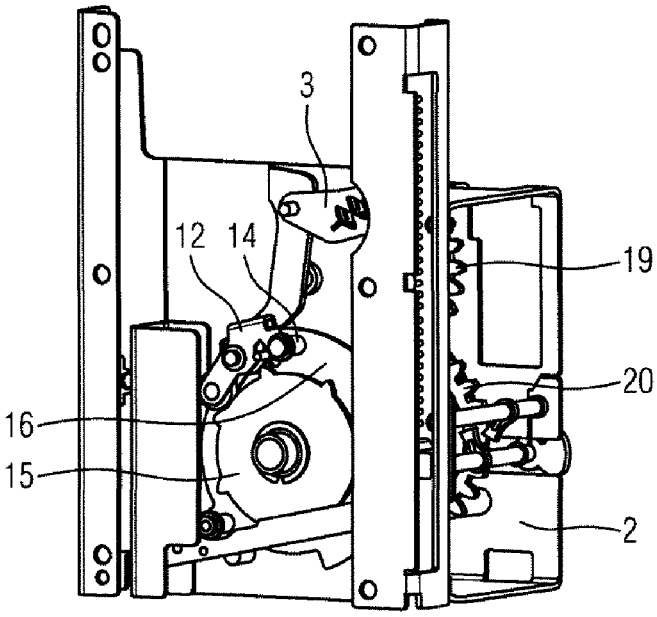

The fourth drive variant, as shown in FIGS. 4*a* to 4*c*, is intended for a two-position circuit breaker as shown in FIG. 3 which, however, is additionally formed with a first and a second clutch disk 15, 16, as well as an additional drive spring 17, for storage of an OFF-ON-OFF switching sequence for brief interruption by renewed loading of the first drive spring 6 after switching on (ON). The first, inner clutch disk 15 is connected to the output shaft 18 and to the first drive spring 6, which is provided for switching on, and the second, outer clutch disk 16 is coupled to the output lever 3, which is connected to the switching device. Rotation of the first tripping half-shaft 13 releases the first storage drive catch 10 and therefore the loaded first drive spring 6. The free energy is partially transmitted via the first, inner clutch disk 15 to the output shaft 18 and therefore to the switching device for the ON switching process, while a further part of it is at the same time used to load the additional drive spring 17. At the end of the ON switching process, the additional drive spring 17, which is provided for switching to OFF, is held in the storage position for switching to OFF by means of a jointly rotating third storage blocking catch 12. The third storage blocking catch 12 and therefore the additional drive spring 17 can now be released by rotation of the second tripping half-shaft 14, in order to switch to OFF, or the first drive spring 6 can be loaded once again, blocked by the first storage blocking catch 10, and held in the storage position. Switching off takes place by means of the jointly rotating third storage blocking catch 12, which fixes the inner and the outer clutch disks 15, 16 with respect to one another. Since the additional drive spring 17 acts on the outer, second clutch disk 16, it is possible to switch to OFF without influencing the first drive spring 6. After loading of the first drive spring 6 with the switching device in the ON state, the OFF-ON-OFF switching sequence which is required for brief interruption can be carried out without having to supply energy once again from the outside.

LIST OF REFERENCE SYMBOLS

1 Mounting plate
2 Mounting plate
3 Output lever
4 First operating shaft
5 Second operating shaft
6 First drive spring
7 Second drive spring
8 First blocking catch
9 Second blocking catch
10 First storage drive blocking catch
11 Second storage drive blocking catch
12 Jointly rotating storage blocking catch
13 First tripping half-shaft
14 Second tripping half-shaft
15 First, inner clutch disk
16 Second, outer clutch disk
17 Additional drive spring
18 Output shaft
19 Gearwheel
20 Gearwheel
21 Cam disk

The invention claimed is:

1. A drive system for electrical switching devices having different functions for medium-voltage switchgear assemblies, the drive system being a snap-action or storage drive system, combinable in a modular form, for three-position switch disconnectors or two-position circuit breakers, the drive system comprising:

an output shaft;

a first drive spring;

a first operating shaft connected to said first drive spring and connected via said output shaft to a switching element of a switching device;

a second operating shaft connected to said first operating shaft such that they engage;

a cam disk;

a first blocking catch connected to the cam disk;

a second blocking catch for switching an ON position and the OFF position for a three-position disconnector with a snap-action function;

a second drive spring;

a first storage blocking catch;

a second storage blocking catch;

a first tripping half-shaft;

a second tripping half-shaft;

said second operating shaft associated with said second drive spring and said second storage blocking catch, which corresponds thereto, in combination with said second tripping half-shaft;

said first drive spring being associated with said first storage blocking catch in combination with said first tripping half-shaft for switching the ON position and the OFF position as a storage function;

wherein in a case of the three-position disconnector, a switching between the OFF position and the GROUNDED position also takes place as a snap-action function via said first tripping spring and said first blocking catch;

wherein when the drive system is used for a two-position load disconnector, said first and second blocking catches are removed;

wherein when used for the two-position load disconnector with OFF-ON-OFF brief interruption a clutch having a jointly rotating storage blocking catch, and first and second clutch disks which are connected via said jointly rotating storage blocking catch, which is temporarily held on said second tripping half-shaft; and an additional drive spring corresponding to said storage blocking catch, said clutch and said additional drive spring disposed between said output shaft and the switching device, in order to achieve the OFF position.

2. The drive according to claim 1, further comprising gearwheels, the engaging connection between said first operating shaft and said second operating shaft takes place via said gearwheels which are provided on said first and second operating shafts.

3. The drive according to claim 1, wherein said first and second drive springs are rotary springs.

4. The drive according to claim 1, wherein said additional drive spring is a tension spring.

5. The drive according to claim 1, wherein said first and second tripping half-shafts each having a momentary-contact lever integrally formed thereon and can be operated manually via said momentary-contact lever.

6. The drive according to claim 1, wherein said first and second operating shafts can be driven manually or by a motor.

7. The drive according to claim 1, further comprising an output lever, said output shaft is connected via said output lever to the switching element of the switching device.

8. A drive system for an electrical switching device for medium-voltage switchgear assemblies with a different function, the drive system being a snap-action system or a storage drive system, which can be combined in a modular form, for three-position switch disconnectors, the drive system comprising:

an output shaft;

a first drive spring;

a first operating shaft connected to said first drive spring and connected via said output shaft to a switching element of the switching device;

a second operating shaft connected to said first operating shaft such that they engage;

a cam disk;

a first blocking catch connected to said cam disk;

said first drive spring associated with said first blocking catch and provided for switching to an OFF position and to a GROUNDED position; and a second blocking catch for switching to an ON position and the OFF position for a three-position disconnector with a snap-action function.

9. A drive system for an electrical switching device for medium-voltage switchgear assemblies with a different function, the drive system being a snap-action system or a storage drive system, which can be combined in a modular form, for three-position switch disconnectors, the drive system comprising:

an output shaft;

a first drive spring;

a first operating shaft connected to said first drive spring and connected via said output shaft to a switching element of the switching device;

a second operating shaft connected to said first operating shaft such that they engage;

a cam disk;

a first blocking catch connected to said cam disk;

said first drive spring associated with said first blocking catch;

a second blocking catch;

a second drive spring;

a first storage blocking catch;

a second storage blocking catch;

a first tripping half-shaft;

a second tripping half-shaft;

said second operating shaft associated with said second drive spring and said second storage blocking catch, which corresponds thereto, in combination with said second tripping half-shaft;

said first drive spring associated with said first storage blocking catch in combination with said first tripping half-shaft for switching a ON position and a OFF position as a storage function;

a switching between the OFF position and a GROUNDED position also takes place as a snap-action function via said first tripping spring and said first blocking catch.

10. A drive system for an electrical switching device for medium-voltage switchgear assemblies with a different function, the drive system being a snap-action system or a storage drive system, which can be combined in a modular form, for two-position switch disconnectors, the drive system comprising:

an output shaft;

a first drive spring;

a first operating shaft connected to said first drive spring and connected via said output shaft to a switching element of the switching device;

a second operating shaft connected to said first operating shaft such that they engage;

a second drive spring;

a first storage blocking catch;

a second storage blocking catch;

a first tripping half-shaft;

a second tripping half-shaft;

said second operating shaft associated with said second drive spring and said second storage blocking catch, which corresponds thereto, in combination with said second tripping half-shaft;

said first drive spring associated with said first storage blocking catch in combination with said first tripping half-shaft for switching a ON position and a OFF position as a storage function;

a switching between the OFF position and a GROUNDED position takes place as a snap-action function via said first tripping spring and said first blocking catch.

11. A drive system for an electrical switching device for medium-voltage switchgear assemblies with a different function, the drive system being a snap-action system or a storage drive system, which can be combined in a modular form, for two-position switch disconnectors, the drive system comprising:

an output shaft;

a first drive spring;

a first operating shaft connected to said first drive spring and connected via said output shaft to a switching element of the switching device;

a second operating shaft connected to said first operating shaft such that they engage;

a second drive spring;

a first storage blocking catch;

a second storage blocking catch;

a first tripping half-shaft;

a second tripping half-shaft;

said second operating shaft associated with said second drive spring and said second storage blocking catch, which corresponds thereto, in combination with said second tripping half-shaft;

said first drive spring is associated with said first storage blocking catch in combination with said first tripping half-shaft for switching a ON position and a OFF position as a storage function;

a switching between the OFF position and a GROUNDED position also takes place as a snap-action function via said first tripping spring and said first blocking catch;

a jointly rotating storage blocking catch;

a clutch having first and second clutch disks which are connected via said jointly rotating storage blocking catch, which is temporarily held on said second tripping half-shaft; and an additional drive spring corresponding to said storage blocking catch, said addition drive spring and said clutch are disposed between said output shaft and the switching device, in order to achieve the OFF position.

* * * * *